United States Patent [19]

Mackowiak et al.

[11] Patent Number: 4,481,010

[45] Date of Patent: Nov. 6, 1984

[54] NON-CORROSIVE CREOSOTE AND SOOT REMOVING COMPOSITION

[75] Inventors: Leonard S. Mackowiak, East Hanover; Frank E. Ellison, Convent Station, both of N.J.; Jay W. Fidler, Port Chester, N.Y.; N. George Tucker, River Vale; Gangdhar M. N. Varma, Lodi, both of N.J.

[73] Assignee: Hercules Chemical Company, Inc., New York, N.Y.

[21] Appl. No.: 534,844

[22] Filed: Sep. 22, 1983

[51] Int. Cl.[3] ..... C10L 10/04; C10L 10/06; C23F 11/18

[52] U.S. Cl. ..... 44/5; 44/DIG. 4; 252/387

[58] Field of Search ..... 44/5; 208/47, 48 R, 208/48 AA; 252/387

[56] References Cited

U.S. PATENT DOCUMENTS

| | | | |
|---|---|---|---|
| 2,014,686 | 9/1936 | Lubovitch et al. | 44/4 |
| 2,247,415 | 7/1941 | Stillman | 44/4 |
| 2,777,761 | 1/1957 | Tarnoski | 44/5 |
| 3,625,907 | 12/1971 | Rosenfeld et al. | 252/387 |
| 3,628,925 | 12/1971 | Milner | 44/51 |
| 3,630,696 | 12/1971 | Milner et al. | 44/4 |
| 3,738,819 | 6/1973 | Milner et al. | 44/4 |
| 3,951,613 | 4/1976 | Kiele | 44/5 |
| 4,159,683 | 7/1979 | Hughes et al. | 110/343 |
| 4,298,497 | 11/1981 | Colombo | 252/387 |

FOREIGN PATENT DOCUMENTS

| | | | |
|---|---|---|---|
| 669744 | 9/1963 | Canada | 44/5 |

*Primary Examiner*—Delbert E. Gantz
*Assistant Examiner*—O. Chaudhuri
*Attorney, Agent, or Firm*—Blum, Kaplan, Friedman, Silberman & Beran

[57] ABSTRACT

A metallic chloride based creosote and soot removing composition including a phosphate corrosion inhibitor to reduce the corrosive attack on metal flue pipes is provided. The composition includes between about 15–60% metallic chloride, 20–60% trisodium phosphate dodecylhydrate, 15–60% anti-cake agents, such as non-swelling clay, sodium sulfate and tricalcium phosphate and 2–10% combustion initiator, such as wood flour.

13 Claims, 1 Drawing Figure

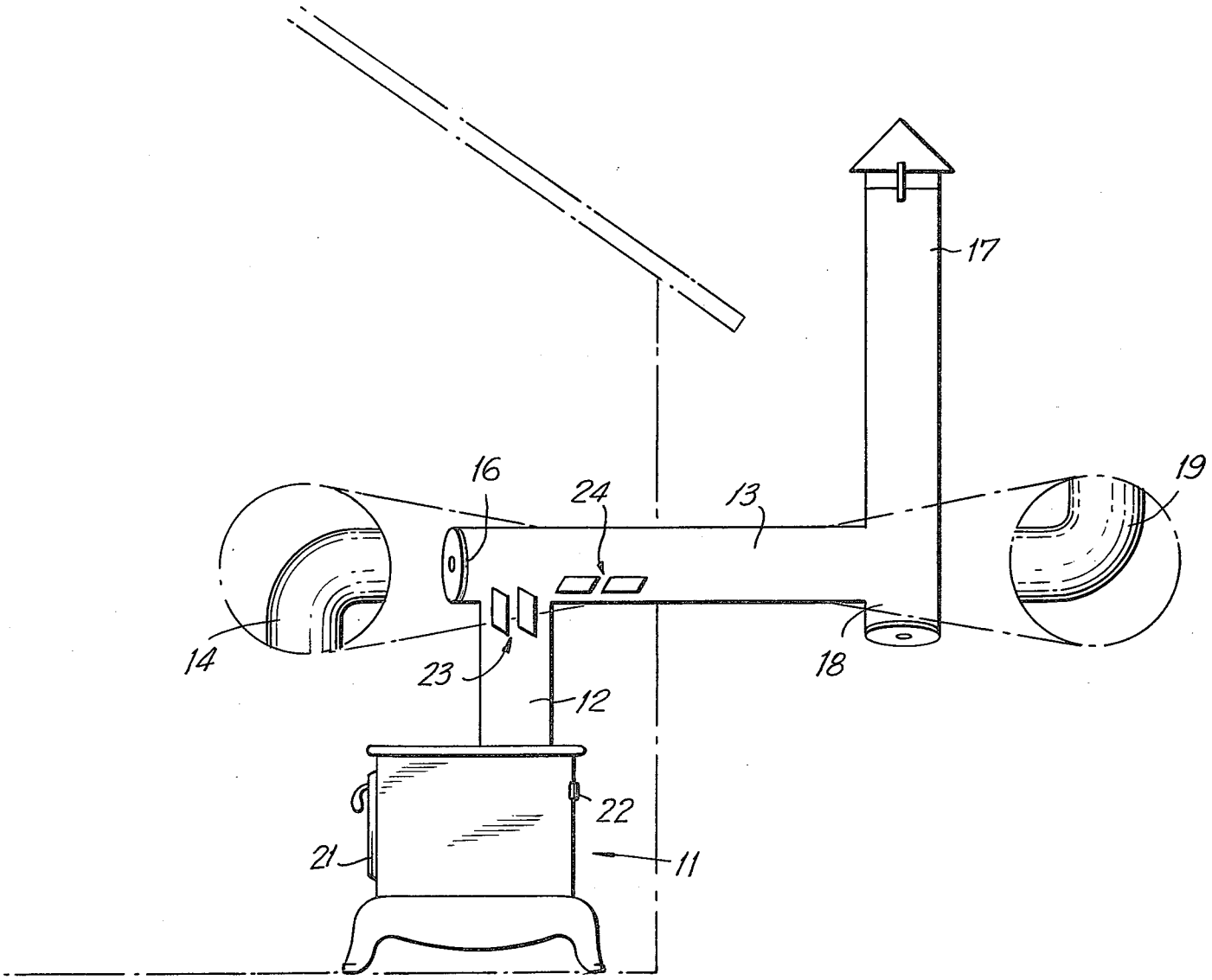
19
17
18
13
11
24
12
22
16
23
21
14

NON-CORROSIVE CREOSOTE AND SOOT REMOVING COMPOSITION

BACKGROUND OF THE INVENTION

This invention relates to a creosote and soot removing composition, and more particularly to a chloride salt-based creosote and soot removing composition having markedly reduced corrosive effect on ferrous metals.

Wood burning stoves have made a dramatic rebirth of use in the home. People are now using these stoves, which are known as "air-tight stoves" to supplement if not heat their homes totally during the winter months. Recent literature discloses that at least seven percent of all homes in the United States have wood burning stoves and that the use is rising constantly.

In these air-tight stoves, the fire is not visible when the stove doors are closed. The fire is regulated generally by a damper in the rear of the stove. A stove user will normally start a fast burning fire with a flame height of six to eight inches. The flame is then permitted to die down after about one hour to a slow burning type combustion to sustain heat output with lower fuel consumption. This low flame condition favors creosote formation.

Creosote is a tar-like material that builds up on stove pipes, and if allowed to go unchecked, can cause several problems. First, after creosote formation a stove may not perform correctly. Second, creosote deposits can eventually build up to the point where they will ignite and cause a chimney fire. Improvements in the design of these stoves have done little to prevent the formation of creosote within the stove flue pipes.

In view of the potentially dangerous conditions which may be created by the proper home use of an air-stove, it is highly desirable to provide ways to reduce the formation of creosote. One such effective way is by the use of a creosote removing material. Creosote removing materials are generally added to a stove fire during use.

The most effective soot removing materials are based upon chloride salts, such as sodium chloride and other metallic chlorides, such as zinc, tin and copper. When an additional metallic chloride is used in combination with sodium chloride, the presence of the additional metal chlorides increases the soot removing effect and promotes more effective soot removal. However, sodium chloride and the other metallic chlorides are quite corrosive to the ferrous materials commonly used in flue pipes of typical air-tight stoves. The metallic chlorides produce progressive pit-type corrosion on iron based metal pipes. Even stainless steel duct work is pitted and severly corroded by use of metallic chloride-based soot and creosote removers. The pit-type corrosion is caused by small electrochemical cells formed on the surface of the metal.

Accordingly, it is desirable to provide an effective metallic chloride-based composition which is effective for removing both creosote and soot, yet which will not cause the severe corrosive effect on metal surfaces generally associated with this type of soot removing material.

SUMMARY OF THE INVENTION

Generally speaking, in accordance with the invention, an improved metallic chloride-based creosote and soot removing composition having reduced corrosive effect on ferrous metals, such as steel and iron, galvanized steel, black iron and flue pipe grades of stainless steel is provided. The composition includes a metallic chloride, such as sodium chloride in combination with trisodium phosphate dodecylhydrate. Based on weight percentage, the composition includes between about 10–60% metallic chloride for effective removal of creosote and soot and 20–60% trisodium phosphate dodecylhydrate which reduces the corrosive effect of the chloride. The preferred composition in accordance with the invention also includes an anti-cake agent, such as between about 10–35% non-swelling clay to maintain the composition as free flowing and between about 3–10% wood flour as a combustion initiator to assist in the start of combustion of the creosote and soot removing composition and 2–20% tricalcium phosphate and up to about 5% sodium sulfate as additional anti-cake agents.

The composition when sprinkled onto a low fire in a typical wood burning stove or fireplace substantially reduces the creosote build-up on flue pipes and chimneys. The composition is also effective in reducing soot deposits in oil, coal and other petroleum source fired heating units. The composition is designed to resist caking under conditions of high humidity and remains free-flowing thereby facilitating ease of application.

Accordingly, it is an object of the invention to provide an improved creosote and soot removing composition.

It is another object of the invention to provide an improved creosote and soot removing composition having reduced corrosive effect on metal flue pipe materials of wood burning stoves.

It is a further object of the invention to provide an improved creosote and soot removing composition effective for soot removal in petroleum-source fired heating units.

Still another object of the invention is to provide an improved creosote and soot removing composition which resists caking.

Still a further object of the invention is to provide an improved method of removing creosote in wood-burning stoves without the corrosive effect on flue pipe materials by adding a composition including a metallic chloride and trisodium phosphate dodecylhydrate to a low flame fire.

Still other objects and advantages for the invention will in part be obvious and will in part be apparent from the specification.

The invention accordingly comprises the composition possessing the features, properties and the relation of components which are exemplified in the following detailed disclosure and the several steps and the relation of one or more of such steps with respect to each of the others and the scope of the invention will be indicated in the claims.

BRIEF DESCRIPTION OF THE DRAWING

For a fuller understanding of the invention, reference is had to the following description taken in connection with the accompanying drawing, in which:

The sole FIGURE is a partial cross-sectional view of a typical wood-burning stove installation which has been modified to permit testing of effectiveness of creosote removing compositions.

DESCRIPTION OF THE PREFERRED EMBODIMENTS

A typical air-tight stove installation is shown generally in the FIGURE. The stove installation was used to evaluate the effectiveness of the creosote removing composition prepared in accordance with the invention as well as additional creosote removing test materials. The stove installation includes a stove 11 and a vertical section of flue pipe 12 coupled to the top of stove 11 leading to a horizontal section of flue pipe 13. Both vertical flue 12 and horizontal flue 13 are present within approximately five feet of stove 11. An elbow joint 14 usually couples vertical flue 12 to horizontal flue 13. However, in order to permit flue pipe clean-out and placement of test panels within vertical flue 12 and horizontal flue 13, elbow 14 was replaced by a T-type joint 16.

Horizontal flue 13 leads to a second vertical section of flue 17 through a second T-type joint 18 which replaced a second elbow 19. Second T-joint 18 was installed to permit flue pipe clean-out and inspection.

Wood-burning stove 11 utilized in the tests described below was manufactured by Franklin Cast Products, Inc. and identified as Model No. 1C.B.O.#3558. The stove was assembled and installed in accordance with the manufacturer's instructions. Vertical flue 12 and horizontal flue 13 were included in the stove installation in order to simulate actual home installations. This type of stove is commonly known as an "air-tight stove" in which after the wood is inserted into the fire, all access doors 21 are closed. The fire is not visible when stove doors 21 are closed. The only way to regulate the air supply to the fire is by means of a small damper 22 in the rear of stove 11.

Several fires were made in stove 11 to establish a reproducible condition to generate creosote. The greatest amount of creosote was generated in the shortest time by a slow-burning fire. This type of fire consisted of a large bed of glowing coals with two or three split logs placed on the coals. The visual flame was approximately two inches in height. If this condition was maintained for a period of six to eight hours, substantial creosote was generated.

In order to test effectiveness of creosote removal, test panel of three inches by five inches of black finished steel or stainless steel were used. Four creosote coated panels 23 were placed in vertical flue 12 and four horizontal panels 24 in horizontal flue 13 at substantially the same distance from stove 11. Panels 23 and 24 were tested within the first five feet of flue pipe installation. The standardized creosote producing fire described above was used to coat panels 23 and 24.

After test panels 23 and 24 were installed a standardized fast-burning fire was started. This fire was one which would produce a visual flame height of approximately six to eight inches. This type of fire was selected for the tests as it was the type of fire a user usually ignited when the fire was started. In the standardized fast burning fire, the flame height was maintained for a one hour period. This was accomplished by regulating the addition of wood and air-damper 22.

After panels 23 and 24 were coated and exposed to the standardized fast burning fire, creosote removing product was added to the fire. The control condition in the comparative studies described below was the use of fire alone with no creosote removing product addition. It was found that a fire with a flame height of six to eight inches burning for two to three hours would remove creosote in the immediate three to five feet of flue pipe from the stove. It is believed that a user would generally start a fire with a six to eight inch flame height, but this would be permitted to die down after a one hour period. Only if the operator was diligent would the six to eight inch flame height be maintained by wood addition or stoking for a prolonged period of time.

The metallic chloride-based creosote and soot removing commposition in accordance with the invention includes, on a weight basis, between about 10–40% metal chloride and 20–60% trisodium phosphate dodecylhydrate. The chloride salts, such as alkali metal salts such as sodium chloride and potassium chloride and chlorides of zinc, tin and copper and the like are known to be effective soot removing materials. However, the chloride salts are also known to be extremely corrosive which make them undesirable for use in a wood burning stove in view of the metallic components used for flue pipes. Addition of trisodium phosphate dodecylhydrate produces a product which is highly effective in creosote removal while maintaining the soot removing properties of the metallic chloride and substantially reduces the corrosive effects of the chloride salts on metal surfaces. The sodium chloride may be admixed with other metallic chlorides for promoting more effective creosote and soot removal. Generally, at least about 3% of a metallic chloride other than sodium chloride is added. Preferably, about 4–10% copper chloride is added. At concentrations of copper chloride above 10% toxicity problems may arise and no further beneficial effect is observed.

In addition to being an effective creosote and soot remover having substantially reduced corrosive effects on metal surfaces, the composition must be suitable for storage. In other words, the composition must be able to be maintained in a free flowing state for ease of use. It has been found that the most effective creosote removing compositions are those which may be spinkled over a fire in a wood burning stove so as to be vaporized more rapidly by the flame.

Suitable anti-cake agents include non-swelling clays, silicas, such as bentonite clays or calcium or aluminum silicates. Preferably, between about 10–40% anti-cake agent is added to the composition to reduce caking. Additional anti-cake agents may also be included in the composition. A preferred anti-cake agent is tricalcium phosphate which should be present in amounts from about 5% to improve the anti-cake properties of the composition and may be included up to about 20%. Sodium sulfate may also be utilized in the most preferred compositions up to about 5%.

Additional components may be added to the creosote and soot removing composition in order to assist combustion and vaporization of the composition, such as 3–20% of a combustion initiator. In the absence of a combustion initiator, the metallic chlorides tend to melt when placed in the fire. Accordingly, from about 3–20% wood flour is added to assist in the start of combustion of the creosote and soot removing composition.

The creosote and soot removing composition prepared in accordance with the invention may include the components in the concentrations noted in the following Table I.

TABLE I

| Component | Percent by Weight General | Preferred |
|---|---|---|
| Metallic Chloride | 10–60 | 15–30 |
| $Na_3PO_4.12H_2O$ | 20–60 | 30–50 |
| Anti-Cake Agent | 15–60 | 30–45 |
| Combustion Initiator | 2–10 | 3–8 |

EXAMPLE 1

A creosote removing formulation having the following composition was prepared for testing.

| Component | Weight Percent |
|---|---|
| Sodium Chloride | 15.0 |
| Trisodium Phosphate, Dodecylhydrate | 38.0 |
| Mineral Colloid 103 Granular* | 24.0 |
| Tricalcium Phosphate, Conditioner Grade | 10.0 |
| Copper Chloride | 6.0 |
| Wood Flour | 5.0 |
| Sodium Sulfate | 2.0 |

*Beacon CMP Corp, Union, New Jersey 07093

In order to test the creosote removing effectiveness of the Example 1 creosote and soot removing composition in accordance with the invention, the composition was tested against various available creosote removing products and a control consisting of the fire alone. Creosote removal was expressed as a percentage of the original weight of creosote present on vertical panels 23 placed in vertical flue 12 and horizontal panels 24 placed in horizontal flue 13 within five feet of stove 11. The panels were weighed and prepared by exposing them to the standard creosote producing fire described above and weighed to determine the weight of creosote.

During the test the standard fast burning fire having a flame height of six to eight inches for one hour time was used. Approximately 100 grams of the Example 1 creosote removing composition was sprinkled onto the fire during the fast burning cycle. For each comparative test product the creosote removing product was added as per the manufacturer's instructions. After such exposure, the test panels were examined for the corrosive effect of the creosote remover. The results of the percentage of creosote removed from panels 23 and 24 and the visible corrosion are set forth in the following Table II.

TABLE II

| Test Products | Usage Level | Percentage Creosote Removal Vertical Panels | Horizontal Panels | Visible* Corrosion |
|---|---|---|---|---|
| Example 1 | 100 gms, loose | 59.6 | 17.4 | 1 |
| Chim Clean (A) | 1 package** (50 gms) | 35.0 | 14.9 | 1–2 |
| | 50 gms loose | 38.4 | 13.1 | 1–2 |
| Attack (B) | 2 scoops** (60 gms) | 47.8 | 13.4 | 1 |
| | 4 scoops (120 gms) | 72.7 | 22.8 | 1 |
| Chimney Sweep (C) | 100 gms loose** | 36.4 | 16.0 | 1–2 |
| | 200 gms loose | 71.6 | 32.0 | 1–2 |
| Flip Stick (D) | 1 stick** (100 gms) | 44.6 | 22.9 | 1–2 |
| | 100 gms loose | 71.6 | 32.0 | 1–2 |
| Fire Only | | 18.2 | 6.2 | — |

*Evaluation Code:
1 = Equal to the effect of fire alone for the test panel.
2 = Moderate visual corrosion exhibited by pitting, etc.
3 = Severe visual corrosion apparent.
**Usage level recommended by the manufacturer. The Chim Clean is provided as a powder in a clear plastic bag for application. Flip Stick is a solid stick. Both products were sprinkled loose over the fire in a second test.
(A) Chim Clean, by Hart Industries, New Albany, Ind. is a zinc and sodium chloride soot remover.
(B) Attack, by ROP'e Marketing International, Inc., Charlottesville Va., is a non-chloride salt creosote remover containing about 54% trisodium phosphate, 2% sodium sulfate anhydrous and 44% mineral colloid.
(C) Chimney Sweep, by Webster Industries, Inc., St. John, New Brunswick, Canada, is a non-chloride salt creosote remover.
(D) Flip Stick, by Hercules Chemical Company, Inc., New York, New York, is a salt-based soot remover containing about 78% sodium chloride, 6% wood flour, 6% copper chloride and 10% tricalcium phosphate.

As can be seen from the comparative tests, the Example 1 composition is the most effective of the products evaluated in removing creosote at manufacturer's recommended usages. Based on the quantitive results, the Example 1 composition was between 12 and 41% more effective than the other three creosote removing preparations at the recommended usage levels. Most importantly, no significant visible corrosion was observed on typical flue pipe materials when the Example 1 composition was applied to a typical rapid burning wood fire. When the usage level of the most effective available creosote removing product was doubled the effectiveness increased. However, as the trisodium phosphate dodecylhydrate concentration of this product is greater than an Example 1-type concentration in accordance with the invention, the trisodium phosphate dodecylhydrate-based product is more expensive in view of the greater cost of the trisodium phosphate dodecylhydrate compared to the sodium chloride used in Example 1. Additionally, the Example 1 composition is an effective soot remover as well as an effective creosote remover.

It will thus be seen that the objects set forth above, among those made apparent from the preceding description, are efficiently attained and, since certain changes may be made in the composition set forth without departing from the spirit and scope of the invention and in carrying out the above method, it is intended that all matter contained in the above description and shown in the accompanying drawing shall be interpreted as illustrative and not in a limiting sense.

It is also to be understood that the following claims are intended to cover all of the generic and specific features of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A non-corosive creosote and soot removing composition comprising a metallic chloride for removing creosote and soot deposits and from about 20 to 60 weight percent of trisodium phosphate dodecylhydrate as a corrosion inhibitor.

2. The composition of claim 1, including between about 15–60% by weight of metallic chloride and 20–60% trisodium phosphate dodecylhydrate.

3. The composition of claim 1, wherein the metal in the metallic chloride is selected from the group consisting of sodium, potassium, zinc, tin, copper and mixtures thereof.

4. The composition of claim 1, further including an effective amount of an anti-cake agent.

5. The composition of claim 4, wherein the anti-cake agent is a non-swelling clay.

6. The composition of claim 4, wherein the anti-cake agent is sodium sulfate.

7. The composition of claim 1, further including an effective amount of a combustion initiator.

8. The composition of claim 7, wherein the combustion initiator is wood flour.

9. The composition of claim 1, wherein the metallic chloride is sodium chloride and copper chloride.

10. A non-corrosive creosote and soot removing composition comprising the following components in the weight percentages set forth:

| Component | Percent by Weight |
|---|---|
| Metallic Chloride | 15–60 |
| Trisodium Phosphate Dodecylhydrate | 20–60 |
| Anti-cake Agent | 15–60 |
| Combustion Initiator | 3–10 |

11. A non-corrosive creosote and soot removing composition comprising the following components in the weight percentages set forth:

| Component | Percent by Weight |
|---|---|
| Sodium Chloride | 10–40 |
| Trisodium Phosphate Dodecylhydrate | 20–60 |
| Non-Swelling Clay | 10–35 |
| Tricalcium Phosphate | 2–20 |
| Copper Chloride | 3–10 |
| Wood Flour | 2–10 |
| Sodium Sulfate | 0–5 |

12. The composition of claim 11, wherein the components are present in the weight percentages set forth:

| Component | Percent by Weight |
|---|---|
| Sodium Chloride | 10–20 |
| Trisodium Phosphate Dodecylhydrate | 30–50 |
| Non-Swelling Clay | 20–30 |
| Tricalcium Phosphate | 7–13 |
| Copper Chloride | 5–7 |
| Wood Flour | 2–10 |
| Sodium Sulfate | 1–4 |

13. A method of removing creosote and soot by adding to a fire a creosote and soot removing composition including a metallic chloride and from about 20 to 60 weight percent trisodium phosphate dodecylhydrate.

* * * * *